United States Patent [19]

Thorsell et al.

[11] 3,973,737

[45] Aug. 10, 1976

[54] PULP GRINDER

[75] Inventors: Sven-Erik Thorsell; Lars Erik Karl Axel Tell, both of Karlstad, Sweden

[73] Assignee: Aktiebolaget Karlstads Mekaniska Werkstad, Karlstad, Sweden

[22] Filed: May 14, 1974

[21] Appl. No.: 469,913

[30] Foreign Application Priority Data

May 14, 1973 Sweden ..... 7306741

[52] U.S. Cl. ..... 241/294; 51/206 NF

[51] Int. Cl.[2] ..... B02C 4/30

[58] Field of Search ..... 241/227, 277, 285 R, 241/293, 294, 295; 51/206 NF

[56] References Cited

UNITED STATES PATENTS

| | | | |
|---|---|---|---|
| 2,201,734 | 5/1940 | Leafe | 51/206 NF |
| 2,887,276 | 5/1959 | Minarik | 241/294 X |
| 3,313,015 | 4/1967 | Spangler | 241/294 X |
| 3,369,763 | 2/1968 | Perry | 241/293 |
| 3,388,871 | 6/1968 | Gundlach | 241/295 |
| 3,620,462 | 11/1971 | Dooley, Jr. | 241/294 |

*Primary Examiner*—Granville Y. Custer, Jr.
*Assistant Examiner*—Howard N. Goldberg
*Attorney, Agent, or Firm*—Brumbaugh, Graves, Donohue & Raymond

[57] ABSTRACT

A pulp grinder comprises a grindstone having separate longitudinally spaced apart shafts mounted for rotation about a common axis and a grindstone structure mounted on the shafts. The grindstone structure includes a tubular shell having flanges at either end, and each shaft includes a flange that mates with a corresponding flange of the tubular shell. The flanges of the respective shafts are detachably connected to the flanges on the tubular shell, thereby facilitating removing the grindstone structure for repair or replacement without requiring disassembly of the shaft journals.

2 Claims, 6 Drawing Figures

PULP GRINDER

BACKGROUND OF THE INVENTION

The shaft arrangement most commonly used for fastening grindstones in grinders used to produce fibrous pulp consists of a heavy shaft extending through the grindstone and through the grinder bearings on each of its sides. To retain the grindstone, the shaft is provided on both sides of the stone. There is a strong screw thread with a righthand thread on one side and a lefthand thread on the other side. Steel discs rigidly attached to nuts fitted on these threads are pressed from both sides of the stone hard up against it. Due to the right and lefthand threads, the pressure of the discs on the stone will increase with an increase in the load to which the stone is subjected. A device of this kind is shown in Swedish Pat. No. 80,084. In Swedish Pat. No. 331,589 an arrangement is shown where a grindstone with a shaft of the type in common use extending through the grindstone has a metallic cylinder coaxially attached to the shaft by means of flanges at each of its ends. The ceramic sectors of the grindstone that perform the grinding work are attached to the shell of the metallic cylinder.

The known arrangements, referred to above, have certain disadvantages. An important disadvantage is that the shaft is weakened by the threads. Fracture of the shaft occurs in the fractural impressions on each side of the stone. A contributory cause of fracture may be that both side faces of the grindstone itself are not truly parallel. Spacers between the steel discs and the side faces of the stone are not made in such a way that the deviation of parallelism is fully compensated, so parts of the threads will be subjected to a high shear stress at the same time the shaft is subjected to a bending stress. The combined shear and bending stresses produced by the feed pressure will create such high stress peaks that after a certain time in operation it will fracture from fatigue. The high torque that the grindstone transmits to the shaft through the threads subjects the shaft to a high tensile stress which contributes to shaft fracture.

A second disadvantage of prior arrangements is exemplified when a used grindstone is removed and a new one is installed. It is not usually possible to center the new stone when it is mounted on the shaft. For that reason, the stone must be machined on the grinder and then sharpened before the grinder can be returned to service.

SUMMARY OF THE INVENTION

There is provided, in accordance with the present invention, an improvement in the grindstones of grinders used to produce fibrous pulp mechanically that overcomes the problems described above with previously known grindstones and provides important advantages in its own right. According to the invention, the grindstone comprises a grindstone structure composed of a tubular shell carrying the grindstone segments and having flanges at either end and a shaft extending outwardly from and coaxially with the shell of the grindstone structure. Each of the shafts has a flange shaped and dimensioned to mate with the corresponding flange of the shell and is journalled for rotation. The respective shafts are detachably connected to the grindstone structure, such as by bolts such that when the parts are assembled, the shell and the two shafts constitute a continuous supporting shaft assembled for the grindstone. Preferably, the shell includes a multiplicity of circumferentially spaced-apart, longitudinally extending radial reinforcing fins, therby greatly strengthening the shell and making it possible to manufacture grindstones that are considerably longer than those that have been manufactured heretofore. Similarly, the flanges are preferably strengthened by filletts in the case of both the shell and the shafts, thereby providing for strong connections to permit higher loadings of the grindstone than are possible with common structures.

In the manufacture of the shell, the end faces can be machined to provide precise parallelism and may be formed with recesses or projections that accommodate corresponding mating projections or recesses on the flanges of the shafts, thereby ensuring that the axis of the continuous shaft assembly is true and the surface of the grindstone is coaxial with the axis of the assembled continuous shaft assembly.

A further important advantage of the invention involves the replacement of the grindstone. More particularly, replacement of a stone requires only that one of the grinder bearings be unfastened and one of the bearing journals be moved slightly aside to release the used stone and fit a new one. The ease of changing a stone greatly reduces the time required.

The shell may be made of cast iron, thus reducing the total cost of the grindstone when compared with the significantly more expensive structures having machined steel shafts and complicated fastening devices for mounting the stone on the shaft. Moreover, the shell of a used grindstone can frequently be salvaged for use in producing a new stone. Additional economies are made possible by permitting inventorying of a fewer number of replacement stones and other components. With the grindstones used heretofore, it was necessary to have one or more spare sets of grindstones, each set including a shaft with a mounted grindstone and bearings in order to reduce the shutdown time for changing stones. With the present invention, it is necessary only to keep spare grindstones and spare bearings on hand, inasmuch as the grindstones are readily interchangeable with the shafts.

DESCRIPTION OF THE DRAWINGS

For a better understanding of the invention, reference may be made to the following description of exemplary embodiments, taken in conjunction with the figures of the accompanying drawings in which.

DESCRIPTION OF AN EXEMPLARY EMBODIMENT

Figure 1:
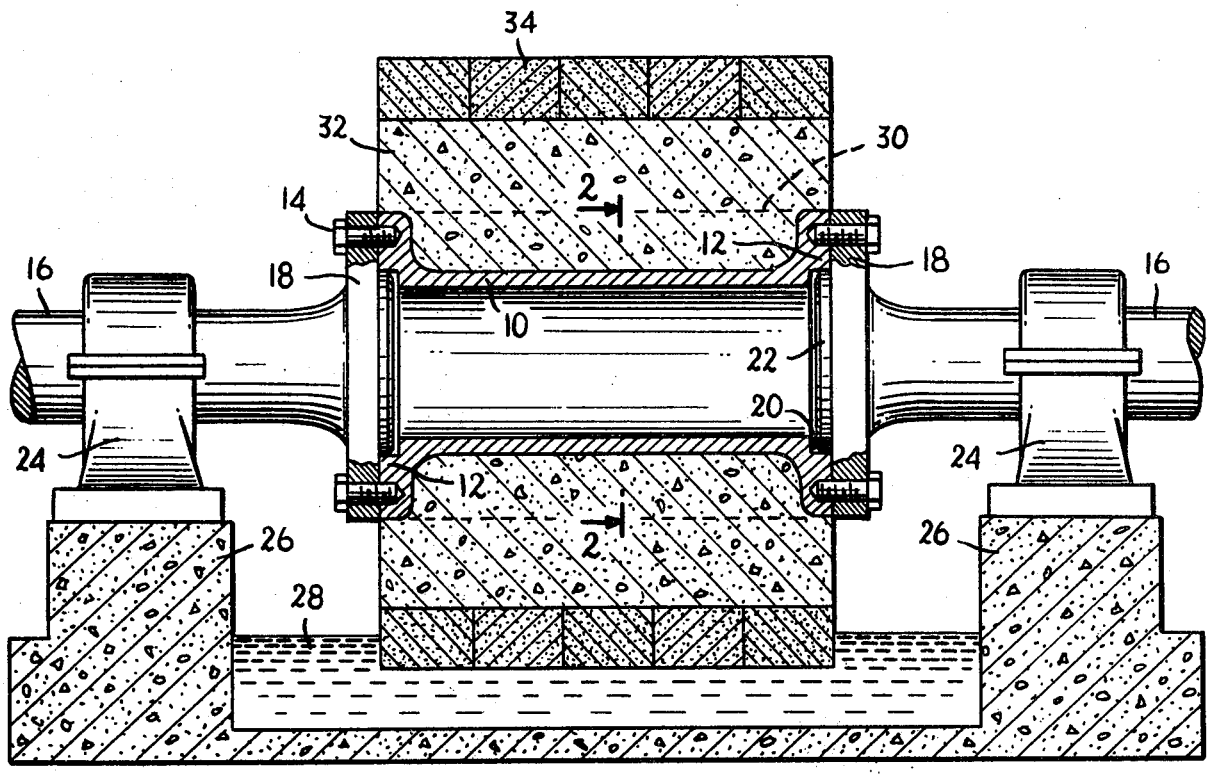
FIG. 1 shows a partial vertical longitudinal section of one embodiment of the invention.
Figure 2:
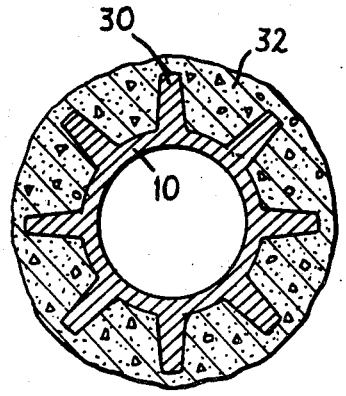
FIG. 2 shows a cross section taken on line 2—2 of FIG. 1.

Referring generally to FIG. 1, an exemplary embodiment of a shaft arrangement according to the invention is shown to comprise a cylindrical metallic shell 10 with flanges 12 at each end. The flanges 12 have a larger diameter than the shell 10 and are connected by bolts 14 to two flanges 18 formed on shaft 16. The flanges 12 of the shell 10 are provided with accurately centered recesses 20. The flanges 18 of the shafts 16 are provided with accurately centered spigots 22 which are adapted to intimately contact the recesses 20 in the shell 10. The shafts 16 are carried in bearings (not visible) within bearing housings 24 mounted on either side of the shell 10. The housings 24 are supported by concrete foundations 26 at the pulp collecting chest 28 of the grinder. The shell 10 is provided with longitudinal reinforcing fins 30, which extend continuously along the shell 10 between the flanges 12 and are joined to the flanges 12. The fins 30 are also connected to the shell 10 and are best seen in FIG. 2.

The shell 10 is embedded in a concrete core 32 to which the segments 34 of the grindstone, which are preferably ceramic, are fastened in a known manner. Either or both of the shafts 16 are connected to a driving means which is usually an electric motor (not shown).

Figure 3:
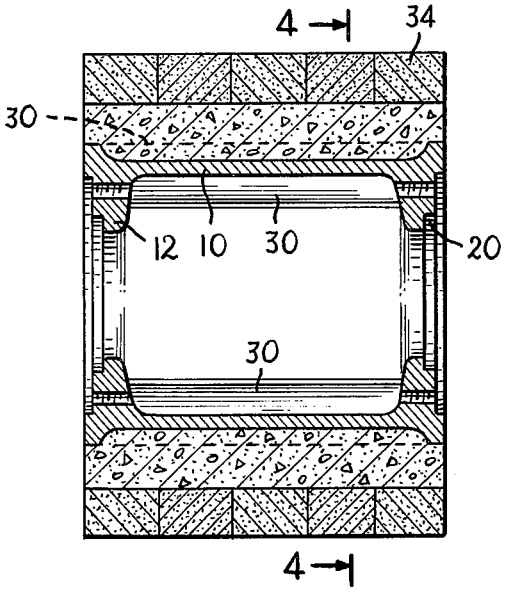
FIG. 3 shows an alternative embodiment of the shell in accordance with the invention.
Figure 4:
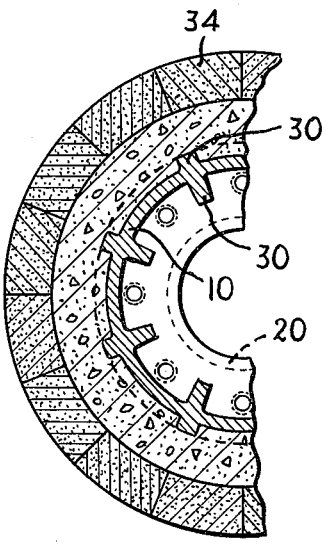
FIG. 4 shows a section taken on line 4—4 of FIG. 3.

FIGS. 3 and 4 show an alternative embodiment of the grindstone with embedded cylindrical shell 10, in which the cylindrical shell 10 has a larger diameter than the pitch circle diameter of the bolted joints.

Figure 5:
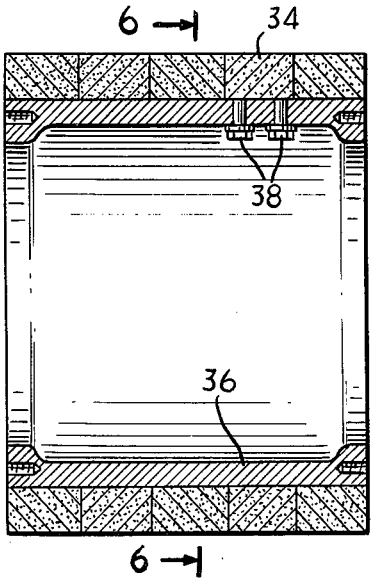
FIG. 5 shows another alternative embodiment of the shell of the invention with the ceramic segments of the grindstone directly attached to the shell.
Figure 6:
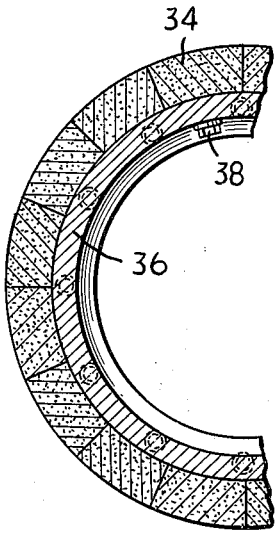
FIG. 6 shows a section taken on line 6—6 in FIG. 5.

FIGS. 5 and 6 show a second alternative embodiment of the grindstone itself with the ceramic grinding segments 34 attached directly to a cylindrical metallic shell 36 by means of screws 38.

Numerous variations and modifications of the invention will be readily apparent to those skilled in the art, and all such variations and modifications are intended to be included within the scope of the invention as defined in the appended claims.

We claim:

1. In a pulp grinder for the mechanical production of fibrous pulp, the improvement in the grindstone thereof comprising a grindstone structure including a tubular shell having a flange at either end and a multiplicity of circumferentially spaced-apart, reinforcing ribs extending continuously longitudinally along the shell between the flanges and joined to the flanges and projecting generally radially from the shell, a body of cementitious material formed and placed on the outside of the shell and including portions received in concavities defined between the reinforcing ribs, a shaft extending coaxially and outwardly from each end of the grindstone structure, each shaft being journalled for rotation and having a flange shaped and dimensioned to mate with a corresponding flange on the tubular shell, and means for detachably connecting the mating flanges of the shell of the respective shafts such that the shell and the two shafts constitute a continuous supporting shaft assembly.

2. In a pulp grinder for the mechanical production of fibrous pulp, the improvement in the grindstone thereof comprising a grindstone structure including a tubular shell having a flange at either end and a multiplicity of circumferentially spaced-apart, reinforcing ribs extending continuously longitudinally along the shell between the flanges and joined to the flanges and projecting generally radially from the shell, a plurality of grindstone segments mounted on the outside of the shell, a shaft extending coaxially and outwardly from each end of the grindstone structure, each shaft being journalled for rotation and having a flange shaped and dimensioned to mate with a corresponding flange on the tubular shell, and means for detachably connecting the mating flanges of the shell of the respective shafts such that the shell and the two shafts constitute a continuous supporting shaft assembly.

* * * * *